US012708981B2

(12) United States Patent
Murasato

(10) Patent No.: US 12,708,981 B2
(45) Date of Patent: Aug. 18, 2026

(54) WORKPIECE HOLDING DEVICE

(71) Applicant: TOKYO SEIMITSU CO., LTD., Hachioji (JP)

(72) Inventor: Tadashi Murasato, Hachioji (JP)

(73) Assignee: TOKYO SEIMITSU CO., LTD., Tokyo (JP)

( * ) Notice: Subject to any disclaimer, the term of this patent is extended or adjusted under 35 U.S.C. 154(b) by 385 days.

(21) Appl. No.: 18/281,936

(22) PCT Filed: Dec. 7, 2021

(86) PCT No.: PCT/JP2021/044819
§ 371 (c)(1),
(2) Date: Sep. 13, 2023

(87) PCT Pub. No.: WO2022/201648
PCT Pub. Date: Sep. 29, 2022

(65) Prior Publication Data

US 2024/0173817 A1 May 30, 2024

(30) Foreign Application Priority Data

Mar. 23, 2021 (JP) ..... 2021-048840

(51) Int. Cl.
*B24B 41/06* (2012.01)

(52) U.S. Cl.
CPC ..... *B24B 41/067* (2013.01)

(58) Field of Classification Search
CPC ..... B23Q 3/002; B23Q 3/06; B23Q 3/067; B23Q 3/152; B24B 41/067
See application file for complete search history.

(56) References Cited

U.S. PATENT DOCUMENTS 5,676,360 A * 10/1997 Boucher ..... B23Q 16/105 269/57
11,059,136 B2 * 7/2021 Walz ..... B23Q 3/103
(Continued)

FOREIGN PATENT DOCUMENTS

JP H06252253 9/1994
JP H10102249 4/1998
(Continued)

OTHER PUBLICATIONS

International Search Report, PCT/JP2021/044819, dated Feb. 22, 2022, 2 pages.
(Continued)

*Primary Examiner* — Lee D Wilson
(74) *Attorney, Agent, or Firm* — Fattibene and Fattibene, LLC; Paul A. Fattibene

(57) ABSTRACT

A workpiece holding device capable of processing a workpiece with high accuracy. A holding section 3 in a processing apparatus 1 is a workpiece holding device that rotatably holds a workpiece W to be processed with a grinding stone 21, the workpiece holding device including a base 34, a chuck 33 that is composed of a material exhibiting a lower thermal expansion coefficient than that of the base 34, is placed on the base 34, and can adsorb and hold the workpiece W, and a clamping member 40 that is attached to the base 34 with gaps G1 and G2 between itself and the chuck 33 in a radial direction D of the base 34 and presses a flange 36*a* of the chuck 33 against the base 34.

5 Claims, 5 Drawing Sheets

(56) References Cited

U.S. PATENT DOCUMENTS

| | | | | |
|---|---|---|---|---|
| 2007/0063453 | A1 | 3/2007 | Ishikawa et al. | 279/3 |
| 2008/0047120 | A1* | 2/2008 | Soroka | B23Q 11/127 409/168 |
| 2014/0318680 | A1 | 10/2014 | Wada et al. | B32B 38/18 |
| 2014/0345805 | A1 | 11/2014 | Maeda et al. | B32B 38/18 |
| 2017/0291225 | A1* | 10/2017 | Yamamoto | B24B 41/067 |
| 2020/0107429 | A1 | 4/2020 | Uchida et al. | H05H 1/2406 |
| 2021/0245314 | A1* | 8/2021 | Pulsifer | B23Q 1/26 |
| 2023/0126644 | A1* | 4/2023 | Mori | B24B 7/16 451/8 |
| 2024/0173817 | A1* | 5/2024 | Murasato | H01L 21/683 |

FOREIGN PATENT DOCUMENTS

| | | |
|---|---|---|
| JP | H1114564 | 5/1999 |
| JP | 2005118979 | 5/2005 |
| JP | 2011222800 | 11/2011 |
| JP | 2014216496 | 11/2014 |
| JP | WO 2013088733 | 4/2015 |
| JP | 2017069429 | 4/2017 |
| JP | 2018050039 | 3/2018 |
| JP | 2020057696 | 4/2020 |

OTHER PUBLICATIONS

International Preliminary Report on Patentability, PCT/JP2021/044819, dated Jan. 26, 2023, 3 pages.

Office Action in counterpart Korean application No. 10-2023-7029290, Dispatch Date Oct. 28, 2024; with English translation; 8 pages.

* cited by examiner

WORKPIECE HOLDING DEVICE

TECHNICAL FIELD

The present invention relates to a workpiece holding device that rotatably holds a workpiece to be processed with a grinding stone.

BACKGROUND ART

In a semiconductor manufacturing field, a processing apparatus for a semiconductor wafer such as a silicon wafer (hereinafter referred to as a "workpiece") presses a grinding stone against a workpiece adsorbed to and held in a chuck table and grinds a surface of the workpiece to be flat.

An example of such a processing apparatus is one that includes a chuck table 100 including an adsorbent 101 that holds a workpiece W and a frame 102 that fixes the adsorbent 101 and a base 104 on which the chuck table 100 is placed and that is integrated with the chuck table 100 via a bolt 103 and substantially equally maintains a temperature of the chuck table 100 at the time of processing by supplying constant temperature chiller water 105 to the adsorbent 101 and the frame 102, as illustrated in FIG. 6(*a*) (see, e.g., Patent Literature 1).

CITATION LIST

Patent Literature

Patent Literature 1: Japanese Patent Laid-Open No. 2017-69429

SUMMARY OF INVENTION

Technical Problem

However, in the processing apparatus described in Patent Literature 1, respective amounts of thermal expansion caused by processing heat of the base 104 made of stainless steel and the chuck table 100 made of alumina do not match each other, the base 104 more greatly expands in a radial direction than the frame 102, and further the bolt 103 causes the chuck table 100 to follow the expansion of the base 104, whereby a concave-shaped warping may occur on an upper surface (adsorption surface) of the chuck table 100, as illustrated in FIG. 6(*b*). There has been a problem that when such a warping occurs, a variation in thickness of the workpiece W after the processing deteriorates in the chuck table 100.

Therefore, there occurs a technical problem to be solved to process a workpiece with high accuracy, and the present invention has its object to solve this problem.

Solution to Problem

To attain the above-described object, a workpiece holding device according to the present invention is a workpiece holding device that rotatably holds a workpiece to be processed with a grinding stone, the workpiece holding device including a base, a chuck that is placed on the base and can adsorb and hold the workpiece, and a clamping member that is attached to the base with a gap between itself and the chuck in a radial direction of the base and presses a peripheral edge of the chuck against the base, the clamping member including a main body section that fastened to the base via a bolt, a rotation stopper protrusion that is offset from the bolt in the radial direction of the base and supported on the main body section, further is fitted in a recess of the chuck to regulate rotation in a circumferential direction of the chuck relative to the base.

According to this configuration, the base and the chuck are each thermally expandable independently while maintaining a state where the clamping member provided in the base presses the peripheral edge of the chuck against the base. Accordingly, even when the base thermally expands relatively more greatly than the chuck with processing heat caused by processing of the workpiece, the workpiece can be processed with high accuracy without a warping occurring on an adsorption surface of the chuck.

Advantageous Effect of Invention

The present invention makes it possible to process a workpiece with high accuracy without a warping occurring on an adsorption surface of a chuck even when a base thermally expands relatively more greatly than the chuck with processing heat caused by processing of the workpiece.

BRIEF DESCRIPTION OF DRAWINGS

FIG. 4*a* is a plan view, FIG. 4*b* is a front view, and FIG. 4*c* is a side view.

FIG. 6*a* is a vertical sectional view, and FIG. 6*b* is a schematic view illustrating how a warping occurs in the chuck table as the base thermally expands.

DESCRIPTION OF EMBODIMENT

Figure 1:
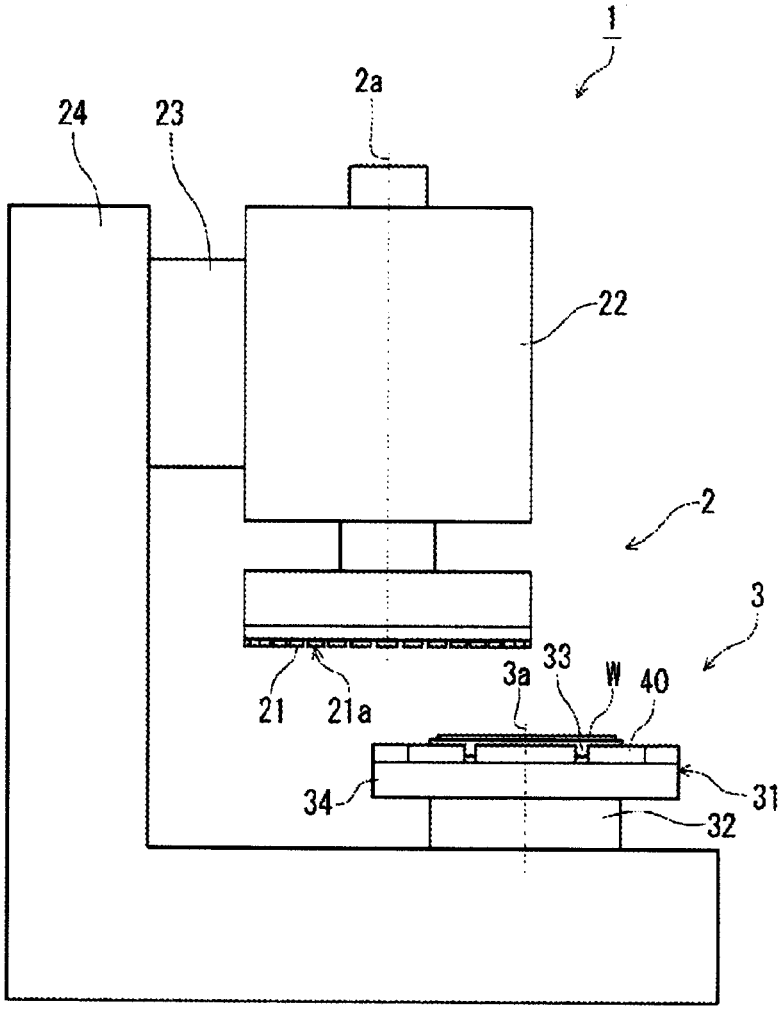
FIG. 1 is a schematic view illustrating a processing apparatus to which a workpiece holding device according to an embodiment of the present invention is applied.

An embodiment of the present invention will be described with reference to the drawings. Hereinafter, when reference is made to the number of components or a numerical value, amount, range, or the like of each of the components, the number or the like is not limited to a particular number but may be the particular number or more or the particular number or less unless otherwise stated or except when expressly limited to the particular number in principle.

When reference to a shape of each of components and a positional relationship among the components, a substantially approximate or similar shape or the like is included unless otherwise stated or except when considered to be expressly excluded in principle.

In the drawings, there is a case where characteristic portions are exaggerated by being enlarged, for example, in order to facilitate the understanding of features, and a dimension ratio or the like of each of the components is not necessarily the same as an actual one. In a cross-sectional view, hatching of some of the components may be omitted in order to facilitate the understanding of a cross-sectional structure of the components.

In the present embodiment, terms representing directions such as up-down and left-right directions are not absolute, but are appropriate if each of the components is in an orientation depicted in the drawings. However, if the orientation has changed, the terms should be construed by being changed depending on the change in the orientation.

A processing apparatus 1 grinds a workpiece W. As illustrated in FIG. 1, the processing apparatus 1 includes a processing section 2 and a holding section 3 as a workpiece holding device.

The processing section 2 includes a grinding stone 21, a grinding stone spindle 22, and an in-feed mechanism 23.

The grinding stone 21 is a cup-shaped grinding stone, for example, and is attached to a lower end of the grinding stone spindle 22.

The grinding stone spindle 22 is configured to be rotatable around a rotation axis 2*a* and such that the grinding stone 21 and the grinding stone spindle 22 are integrally rotatable.

The in-feed mechanism 23 raises and lowers the grinding stone spindle 22 in a vertical direction. The in-feed mechanism 23 has a known configuration, and is constituted by a plurality of linear guides that guide a movement direction of the grinding stone spindle 22 and a ball screw slider mechanism that raises and lowers the grinding stone spindle 22. The in-feed mechanism 23 is interposed between the grinding stone spindle 22 and a column 24.

The holding section 3 includes a chuck table 31 and a chuck spindle 32.

Figure 2:
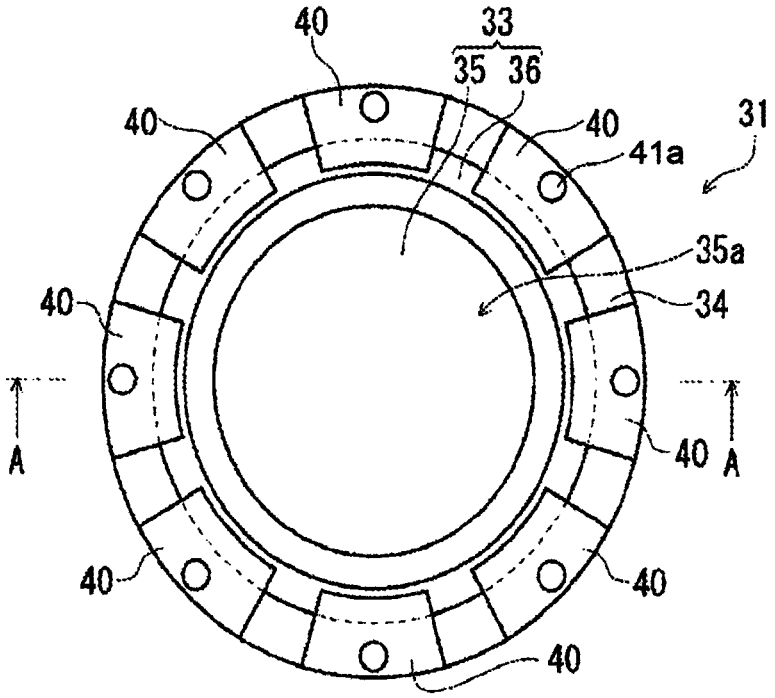
FIG. 2 is a plan view illustrating the workpiece holding device.
Figure 3:
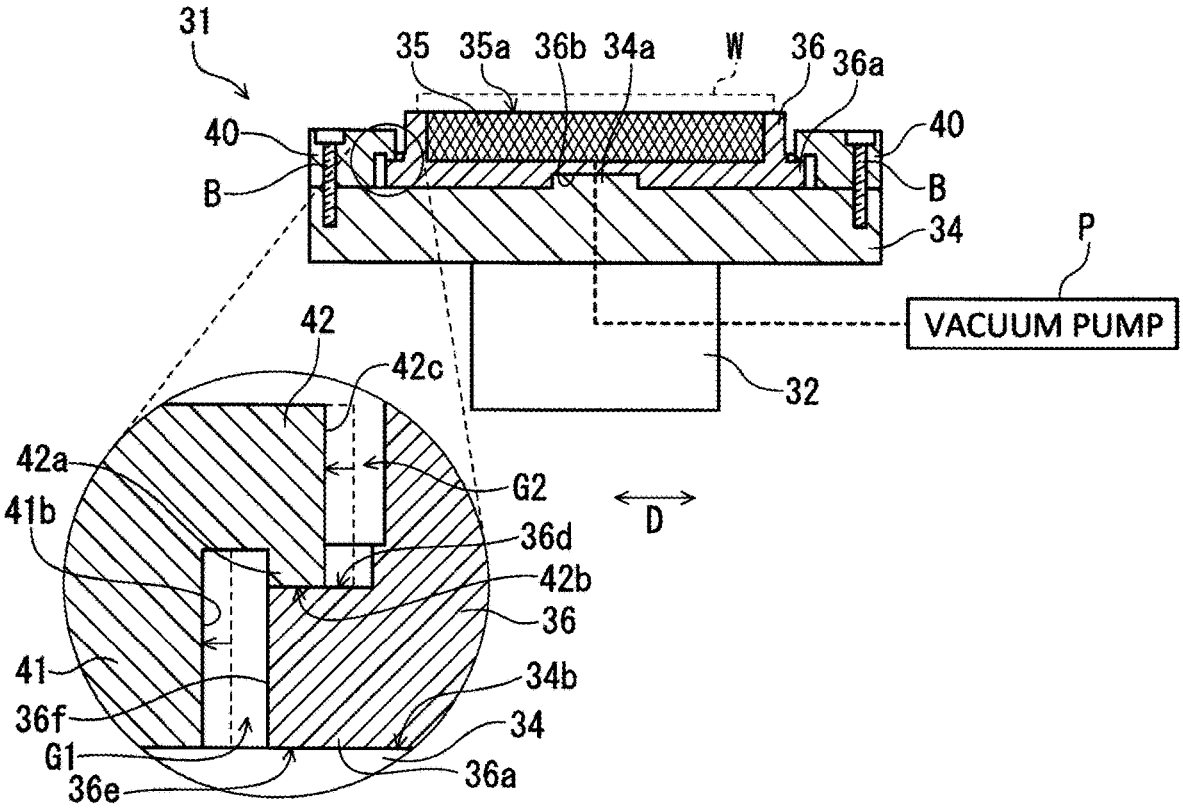
FIG. 3 is a cross-sectional view taken along a line A-A illustrated in FIG. 2 and a partially enlarged view.

As illustrated in FIGS. 2 and 3, the chuck table 31 includes a chuck 33 and a base 34.

The chuck 33 includes an adsorbent 35 and a frame 36. The adsorbent 35 is formed in a shape corresponding to the workpiece W as viewed from the top. The adsorbent 35 is composed of an alumina porous material.

The chuck table 31 includes a duct not illustrated extending to its surface through its inner portion. The duct is connected to a vacuum pump P and a compressed air source or a water supply source not illustrated via a rotary joint not illustrated. When the vacuum pump P is started, a negative pressure occurs between the workpiece W placed on the adsorbent 35 and an upper surface (adsorption surface 35*a*) of the adsorbent 35, whereby the workpiece W is adsorbed to and held in the adsorption surface 35*a*. When the compressed air source or the water supply source is started, adsorption between the workpiece W and the adsorbent 35 is released.

The frame 36 is composed of an alumina dense body with the adsorbent 35 embedded at its substantial center. A flange 36*a* is formed on the outer periphery of the frame 36.

For the adsorbent 35 and the frame 36, alumina is generally used, as described above, but silicon carbide being light in weight and excellent in corrosion resistance and heat resistance, aluminum nitride exhibiting good thermal conductivity, or the like may be used if a material exhibiting a lower thermal expansion coefficient than that of the base 34.

The base 34 is connected to the chuck spindle 32. A projection 34*a* provided at the center on an upper surface of the base 34 is closely fitted in a central recess 36*b* provided at the center of a lower surface of the frame 36, whereby the center of the frame 36 and the center of the base 34 match each other.

The base 34 is composed of a material exhibiting a higher thermal expansion coefficient than those of the adsorbent 35 and the frame 36, for example, stainless steel. The thermal expansion coefficient of alumina is $7.2\times10^{-6}$/° C., and the thermal expansion coefficient of stainless steel (SUS 304) is $17.3\times10^{-6}$/° C.

Figure 4A:
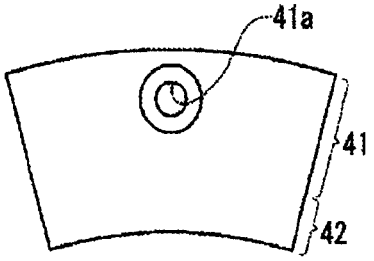
FIGS. 4*a-c* are diagrams illustrating a structure of a clamping member, where
Figure 4B:
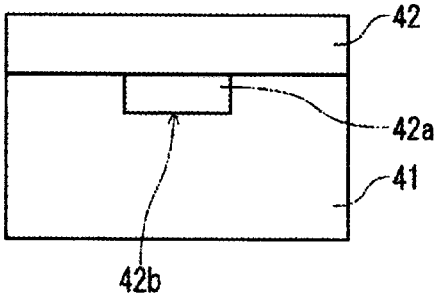
Figure 4C:
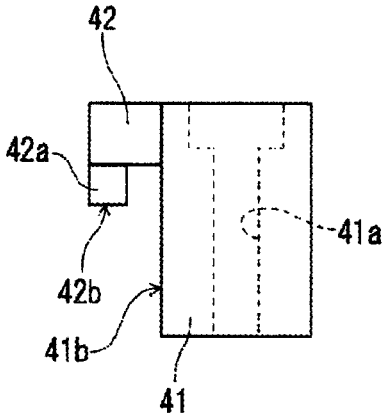

As illustrated in FIG. 4, the chuck table 31 includes a clamping member 40. The clamping member 40 includes a main body section 41 and an overhanging section 42. The clamping member 40 is composed of stainless steel, for example.

The main body section 41 is formed in a substantially fan shape as viewed from the top. The main body section 41 is fastened to the base 34 via a bolt B inserted into a bolt hole 41*a*.

Figure 5:
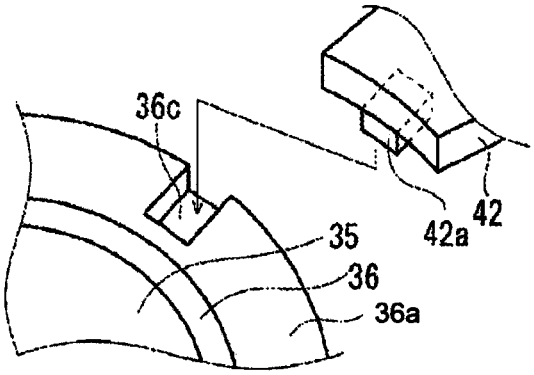
FIG. 5 is a perspective view illustrating an attachment position of the clamping member to a chuck table.
Figure 6A:
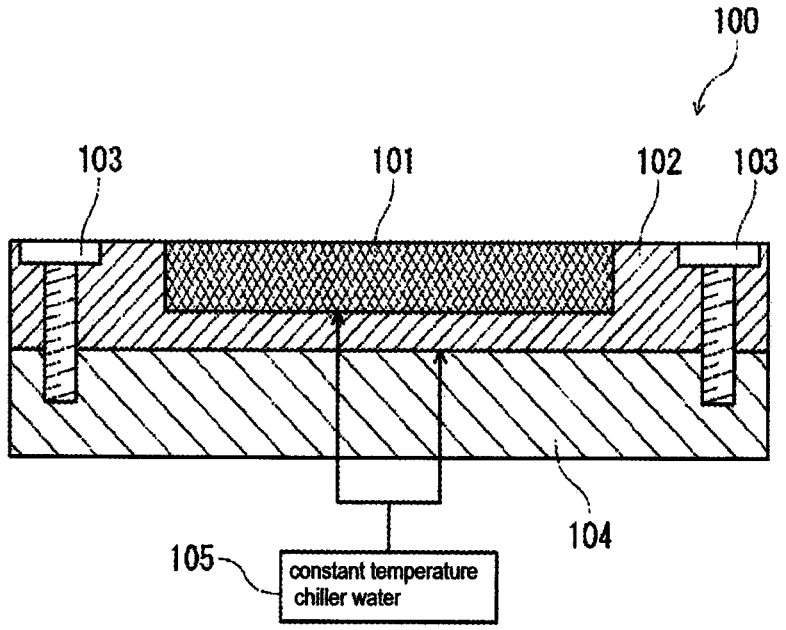
FIG. 6a (Prior Art)
FIGS. 6*a-b* are diagrams illustrating a conventional chuck table and base, where
Figure 6B:
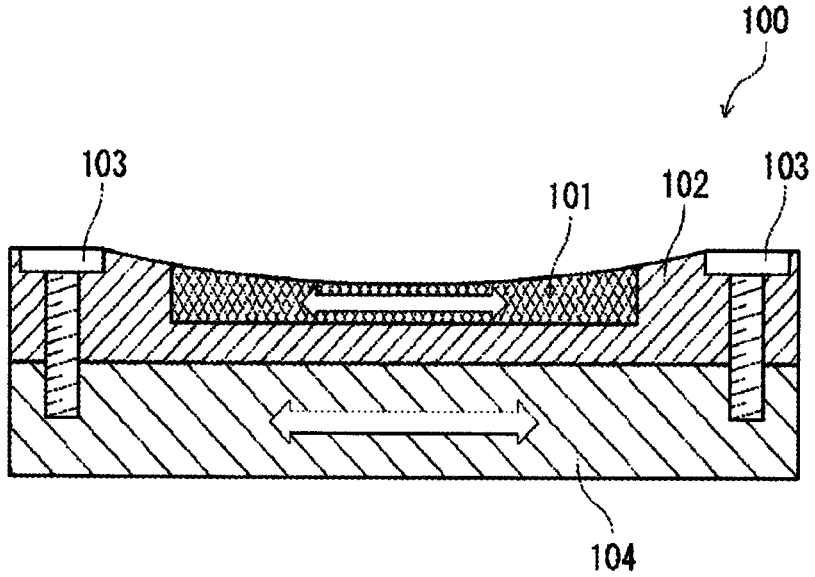
FIG. 6b (Prior Art)

The overhanging section 42 is provided to stand on an inner side surface 41*b* of the main body section 41. A rotation stopper protrusion 42*a* is provided on a lower surface of the overhanging section 42. As illustrated in FIG. 5, the rotation stopper protrusion 42*a* is configured to be fittable in an outer peripheral recess 36*c* formed on a surface of the flange 36*a*.

The rotation stopper protrusion 42*a* presses the flange 36*a* against the base 34 with a fastening force of the bolt B. Specifically, a surface to be clamped 36*d*, which opposes the overhanging section 42, of the flange 36*a* is pressed toward the base 34 by a clamping surface 42*b*, which opposes the flange 36*a*, of the rotation stopper protrusion 42*a*. The rotation stopper protrusion 42*a* is offset from the bolt B and is supported on the main body section 41 in a cantilever manner, thereby preventing an excessive clamping force from acting on the flange 36*a* with the fastening force of the bolt B. The rotation stopper protrusion 42*a* moves relative to the chuck 33 as the base 34 thermally expands, described below, and is thus sized to be contactable with the flange 36*a* before and after the movement.

At least one of a lower surface 36*e* of the frame 36 and an upper surface 34*b* of the base 34 is preferably coated with an easy-slipping layer exhibiting a low friction property not illustrated. The easy-slipping layer is composed of graphite, molybdenum disulfide, or DLC (diamond like carbon), for example. Alternatively, at least one of the frame 36 and the base 34 is preferably composed of graphite, molybdenum disulfide, or DLC, for example, exhibiting a low friction property due to a solid lubricant being dispersed therein.

At least one of the surface to be clamped 36*d* and the clamping surface 42*b* is preferably coated with an easy-slipping layer exhibiting a low friction property not illustrated. The easy-slipping layer is composed of graphite, molybdenum disulfide, or DLC, for example. Alternatively, at least one of the frame 36 and the clamping member 40 is preferably composed of graphite, molybdenum disulfide, or DLC, for example, exhibiting a low friction property due to a solid lubricant being dispersed therein.

Gaps G1 and G2 are respectively ensured between the inner side surface 41*b* of the main body section 41 and an inner peripheral surface 42*c* of the overhanging section 42 and an outer peripheral surface 36*f* of the frame 36. The gaps G1 and G2 are set such that the clamping member 40 does not contact the frame 36 in a radial direction D in an initial state before the base 34 expands in the radial direction D with processing heat.

The chuck spindle 32 is configured to drive the chuck table 31 to rotate around a rotation axis 3*a*. A driving source of the chuck spindle 32 may be a servo motor, for example.

An operation of the processing apparatus 1 is controlled by a control unit not illustrated. The control unit controls each of components constituting the processing apparatus 1. The control unit includes a CPU and a memory, for example. A function of the control unit may be implemented by control using software, or may be implemented by operating using hardware.

Then, a function of the processing apparatus 1 will be described.

First, the workpiece W is placed on the chuck 33 via a conveyance robot or the like not illustrated. When a negative pressure is generated between the workpiece W and the adsorption surface 35*a* using the vacuum pump P, the workpiece W is adsorbed to and held in the adsorbent 35.

Then, the grinding stone 21 is moved to above the workpiece W by a slider of the in-feed mechanism 23. A grinding surface 21*a* of the grinding stone 21 is pressed against the workpiece W while the grinding stone 21 and the chuck 33 are respectively rotated, whereby the workpiece W is ground. For example, the number of revolutions of the grinding stone 21 is set to 2000 rpm, and the number of revolutions of the workpiece W is set to 300 rpm. The rotation stopper protrusion 42*a* is fitted in the outer peripheral recess 36*c* to regulate the rotation in the radial direction D of the chuck 33. Accordingly, rotation driving of the chuck spindle 32 is transmitted to the chuck 33.

As processing of the grinding stone 21 proceeds, the base 34 and the chuck 33 thermally expand with processing heat caused by friction, to be deformed such that respective diameters thereof increases in the radial direction D. Respective amounts of thermal expansion of the base 34 and the chuck 33 differ from each other. Accordingly, the base 34 thermally expands relatively more greatly than the chuck 33 such that the upper surface 34*b* of the base 34 slips relative to the lower surface 36*e* of the frame 36.

At this time, when at least one of the lower surface 36*e* of the frame 36 and the upper surface 34*b* of the base 34 is coated with an easy-slipping layer or when at least one of the frame 36 and the base 34 is composed of a material exhibiting a low friction property, the base 34 thermally expands relatively more greatly than the chuck 33.

As indicated by an imaginary line in FIG. 3, even if the clamping member 40 moves outward in the radial direction D such that the clamping surface 42*b* slips sideways on the surface to be clamped 36*d* as the base 34 thermally expands, the rotation stopper protrusion 42*a* continues to press the flange 36*a* against the base 34.

That is, when the clamping member 40 presses the chuck 33 against the base 34 with the gaps G1 and G2 therebetween, thereby making it possible to avoid the chuck 33 and the clamping member 40 interfering with each other when the chuck 33 and the base 34 thermally expand.

At this time, when at least one of the surface to be clamped 36*d* and the clamping surface 42*b* is coated with an easy-slipping layer or when at least one of the frame 36 and the clamping member 40 is composed of a material exhibiting a low friction property, the clamping member 40 easily moves relative to the chuck 33.

When the workpiece W is ground to a desired thickness by a film thickness sensor or the like not illustrated, respective rotations of the grinding stone 21 and the chuck 33 are stopped, and the slider of the in-feed mechanism 23 is started, to cause the grinding stone 21 to retreat from the workpiece W. Adhesion and holding of the workpiece W by the chuck 33 are released so that grinding of the workpiece W by the processing apparatus 1 is finished.

Thus, the holding section 3 according to the present embodiment is the workpiece holding device that rotatably holds the workpiece W to be processed with the grinding stone 21, the workpiece holding device being configured to include the base 34, the chuck 33 that is composed of a material exhibiting a lower thermal expansion coefficient than that of the base 34, is placed on the base 34, and can adsorb and hold the workpiece W, and the clamping member 40 that is attached to the base 34 with the gaps G1 and G2 between itself and the chuck 33 in the radial direction D of the base 34 and presses the flange 36*a* of the chuck 33 against the base 34.

According to such a configuration, the base 34 and the chuck 33 can each thermally expand independently while maintaining a state where the clamping member 40 provided in the base 34 presses the flange 36*a* against the base 34. Accordingly, even when the base 34 thermally expands relatively more greatly than the chuck 33 with processing heat caused by processing of the workpiece W, the workpiece W can be processed with high accuracy without a warping occurring on the adsorption surface 35*a* of the chuck 33.

The holding section 3 according to the present embodiment is configured to include the rotation stopper protrusion 42*a* that is fitted in the outer peripheral recess 36*c* in the chuck 33 to regulate rotation in a circumferential direction of the chuck 33 relative to the base 34.

This configuration makes it possible to grind the workpiece W to be held in the chuck 33 with high accuracy because the rotation stopper protrusion 42*a* is fitted in the outer peripheral recess 36*c* to regulate the rotation in the circumferential direction of the chuck 33.

It should be understood that various modifications can be made without departing from the spirit of the prevent invention and the present invention covers the modifications.

Although eight clamping members 40 are provided to be equally spaced apart from one another on the outer periphery of the frame 36 in the present embodiment, the number of clamping members 40 to be installed may be seven or less or nine or more. A shape of each of the clamping members 40 is not limited to the above-described one, but the clamping member 40 may be formed in an annular shape to surround the frame 36, for example.

When the rotational speed of the chuck 33 is low and rotation of the chuck 33 need not be stopped in a circumferential direction, the clamping member 40 may be configured to stop the rotation of the chuck 33 in the circumferential direction by omitting the rotation stopper protrusion 42*a* and using only a static friction force of a force for pressing the chuck 33 against the base 34.

Although a case where the chuck 33 is made of a material exhibiting a lower thermal expansion coefficient than that of the base 34 has been described in the preset embodiment, a material for the chuck 33 is not limited to this.

If the chuck 33 is made of a material exhibiting a higher thermal expansion coefficient than that of the base 34, for example, the chuck 33 thermally expands relatively more greatly than the base 34 with processing heat caused by processing of the workpiece W. Even in such a case, the configuration according to the present invention makes it possible to process the workpiece W with high accuracy without a warping occurring on the adsorption surface 35*a* of the chuck 33 because the base 34 and the chuck 33 can each thermally expand independently while maintaining a state where the clamping member 40 provided in the base 34 presses the flange 36*a* against the base 34.

Further, if the chuck 33 and the base 34 are respectively made of materials exhibiting substantially equal thermal expansion coefficients, processing heat caused by processing of the workpiece W is more transmitted to the chuck 33 than the base 34 so that the chuck 33 thermally expands relatively more greatly than the base 43. Even in such a case, the configuration according to the present invention makes it possible to process the workpiece W with high accuracy without a warping occurring on the adsorption surface 35*a* of the chuck 33 because the base 34 and the chuck 33 can each thermally expand independently while maintaining a state where the clamping member 40 provided in the base 34 presses the flange 36*a* against the base 34.

REFERENCE SIGNS LIST

1: processing apparatus
2: processing section
21: grinding stone
21*a*: grinding surface
22: grinding stone spindle
23: in-feed mechanism
24: column
3: holding section
31: chuck table
32: chuck spindle
33: chuck
34: base
34*a*: projection
34*b*: upper surface of (base)
35: adsorbent
35*a*: adsorption surface
36: frame
36*a*: flange
36*b*: central recess
36*c*: outer peripheral recess
36*d*: surface to be clamped
36*e*: lower surface (of frame)
36*f*: outer peripheral surface (of frame)
40: clamping member
41: main body section
41*a*: bolt hole
41*b*: inner side surface (of main body section)
42: overhanging section
42*a*: rotation stopper protrusion
42*b*: clamping surface
42*c*: inner peripheral surface (of overhanging section)
G1, G2: gap
W: workpiece

What is claimed is:

1. A workpiece holding device that rotatably holds a workpiece to be processed with a grinding stone, the workpiece holding device comprising:

a base having a first matching element;

a chuck that is placed on the base and can adsorb and hold the workpiece, the chuck having a frame with a second matching element, wherein the first and second matching elements match each other and fit together; and a clamping member that is attached to the base with a gap between the clamping member and the frame of the chuck in a radial direction of the base and presses a peripheral edge of the frame of the chuck against the base, the clamping member comprising:

a main body section that is fastened to the base via a bolt, a rotation stopper protrusion that is offset from the bolt in the radial direction of the base and supported on the main body section, the rotation stopper protrusion is fitted in a recess in the frame of the chuck to restrict rotation in a circumferential direction of the chuck relative to the base, wherein the gap is formed on each opposing side of the rotation stopper protrusion in a radial direction.

2. The workpiece holding device according to claim 1, wherein at least one of an opposite surface, which opposes the chuck, of the base and an opposite surface, which opposes the base, of the chuck is coated with an easy-slipping layer that urges the base to slip sideways relative to the chuck.

3. The workpiece holding device according to claim 1, wherein at least one of the base and the chuck is composed of a material that urges the base to slip sideways relative to the chuck.

4. The workpiece holding device according to claim 1, wherein at least one of a surface to be clamped, which opposes the clamping member, of the chuck and a clamping surface, which opposes the chuck, of the clamping member is coated with an easy-slipping layer that urges the clamping member to slip sideways relative to the chuck.

5. The workpiece holding device according to claim 1, wherein at least one of the chuck and the clamping member is composed of a material that urges the clamping member to slip sideways relative to the chuck.

* * * * *